US006637299B1

(12) United States Patent
Steele

(10) Patent No.: US 6,637,299 B1
(45) Date of Patent: Oct. 28, 2003

(54) WRENCH WITH ROTATING HEADS

(76) Inventor: Brian R. Steele, 167 Lear Cir., Thousand Oaks, CA (US) 91360

( * ) Notice: Subject to any disclaimer, the term of this patent is extended or adjusted under 35 U.S.C. 154(b) by 0 days.

(21) Appl. No.: 09/954,802

(22) Filed: Sep. 19, 2001

(51) Int. Cl.[7] ..... B25B 13/00
(52) U.S. Cl. ..... 81/124.5; 81/125.1; 81/57.5
(58) Field of Search ..... 81/124.3–124.5, 81/124.7, 125.1, 178, 57.5, DIG. 11, 177.6–177.9, 177.4

(56) References Cited

U.S. PATENT DOCUMENTS 1,723,033 A * 8/1929 Hartley ..... 81/73
1,796,083 A * 3/1931 Carlberg ..... 81/124.5
2,097,361 A * 10/1937 Bagley ..... 81/177.6
2,628,522 A * 2/1953 Kraft ..... 81/125.1
2,951,405 A * 9/1960 Engquist ..... 81/125.1
4,694,711 A * 9/1987 Yang ..... 81/57.5
6,305,254 B1 * 10/2001 Hsieh ..... 81/124.5

* cited by examiner

*Primary Examiner*—D. S. Meislin
(74) *Attorney, Agent, or Firm*—Allan M. Shapiro

(57) ABSTRACT

An elongated wrench handle has a yoke at each end. A wrench head is pivotally mounted in each yoke, and each wrench head has two sets of wrenching surfaces. The wrench head can be rotated in its yoke to expose, in an outer operative position, either of the wrenching surfaces. The wrench head closely fits within the yoke so that a maximum torque can be transferred from the wrench handle to the selected wrenching surface.

10 Claims, 1 Drawing Sheet

FIG. 2
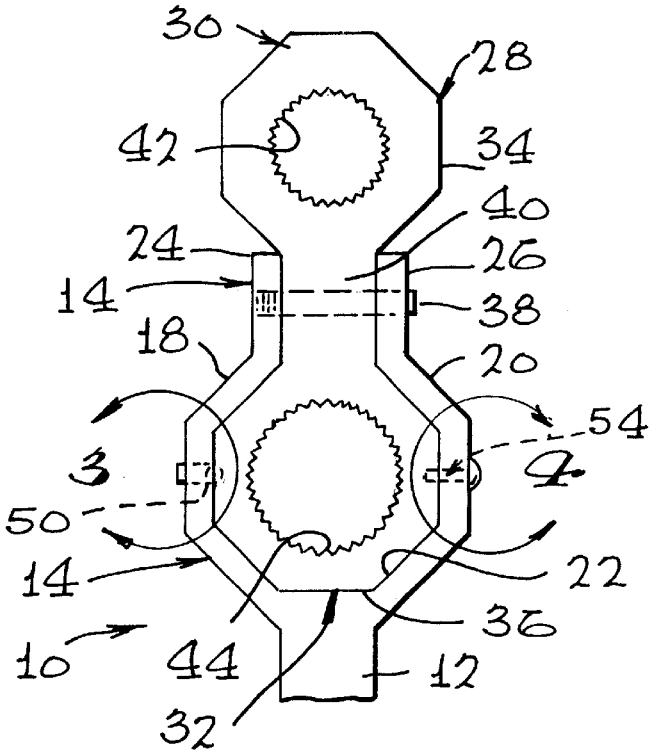
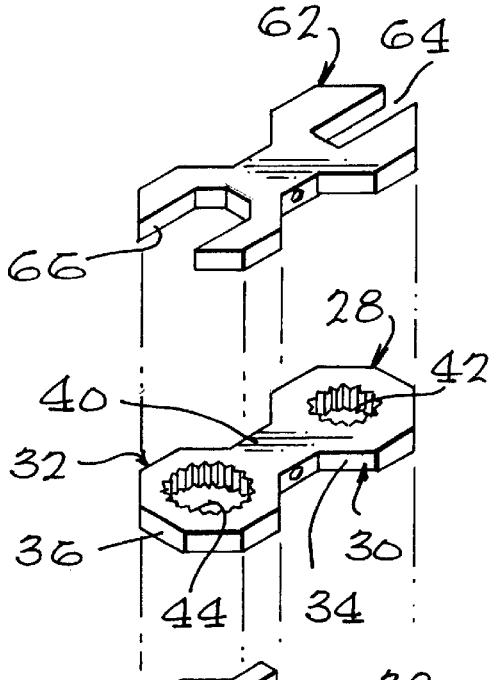
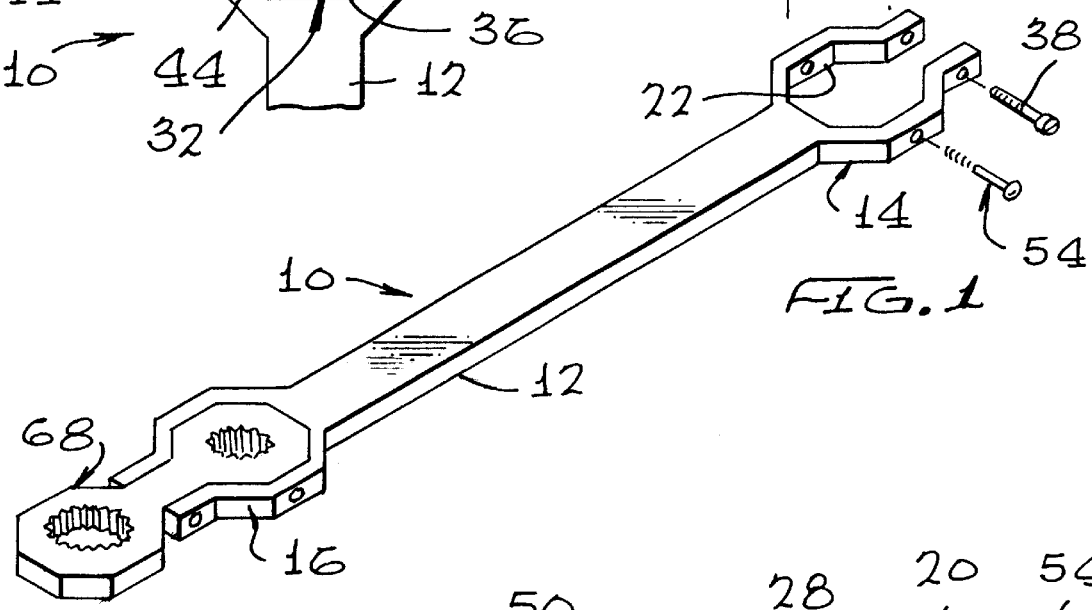
FIG. 1
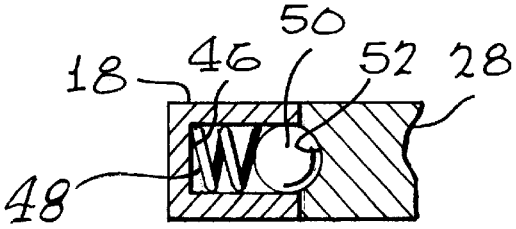
FIG. 3
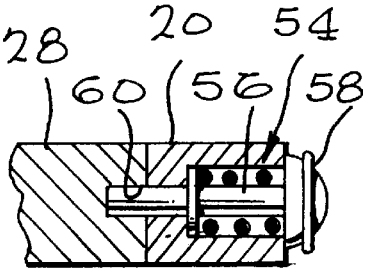
FIG. 4

WRENCH WITH ROTATING HEADS

FIELD OF THE INVENTION

This invention is directed to a manually-actuated wrench for tightening and loosening bolts. The wrench has a plurality of wrench openings, one of which can be selected for the present task.

BACKGROUND OF THE INVENTION

In many construction and repair situations, the workman must go to the site of construction or repair activity. Since he must go to the site, it is burdensome to carry with him a full selection of tools. This is particularly true where parts are bolted together with large bolts because, under such circumstances, large wrenches are required. A plurality of large wrenches thus presents considerable weight. It is desirable to structure these large wrenches in such a manner, without losing strength, that they are capable of acting on different sizes of bolts so that a minimum number of wrenches is required, to limit the weight of tools necessary to transport to the job site.

There is presently available a selection of several types of wrench sets wherein a single handle can be employed with a device which engages on the bolt, for example, a socket set. However, there is not available such a system where maximum torque can be applied by the use of long-handled, heavy duty wrenches. Thus, there is a need for a heavy duty wrench which has a plurality of wrench openings, each one of which can be selected readily for use.

SUMMARY OF THE INVENTION

In order to aid in the understanding of this invention, it can be stated in essentially summary form that it is directed to a wrench with rotating heads wherein the wrench handle has a yoke opening at one end and a head with a wrench opening and which has an external configuration which closely fits the yoke opening. Different heads are available which have different wrench openings but have an external configuration which closely fits the same yoke opening so that the wrench head can be changed.

It is thus a purpose and advantage of this invention to provide a wrench which can be carried to a job site and provide, at the job site, a selectable wrench opening which can be applied to a bolt so that heavy torque is applied to the bolt.

It is another purpose and advantage of this invention to provide a wrench handle which has a yoke at one end and a head which is rotatable in the yoke opening from a first position to a second position and, in both the first position and second position, the head closely fits the yoke opening to maximize torque transmitted from the handle to the wrench head without damage to the wrench.

It is a further purpose and advantage of this invention to provide a wrench with a yoke on at least one end of the wrench handle and rotatably mounted in the yoke is a rotating wrench head with two wrench openings in each wrench head which closely fit within the yoke in two positions.

It is a further purpose and advantage of this invention to provide a wrench with a rotating head within a yoke on each end of the wrench handle, with each of the heads closely fitting within the yokes, each rotating wrench head having two wrench openings so that the wrench opening to be used can be selected out of four wrench openings.

The features of this invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is an exploded isometric view of the wrench with rotating heads of this invention.

FIG. 2 is an enlarged plan view of one end of the wrench of FIG. 1.

FIG. 3 is an enlarged section taken along line 3—3 of FIG. 2.

FIG. 4 is an enlarged section taken along line 4—4 of FIG. 2.

DESCRIPTION OF THE PREFERRED EMBODIMENTS

The wrench with rotating heads of this invention is generally indicated at 10 in FIGS. 1 and 2. The wrench 10 has a handle 12 which is elongated and configured to apply torque and thus is strong and configured for manual engagement. The handle is bifurcated at each end with yoke 14 at the far end in FIG. 1 and yoke 16 at the near end. The two yokes are the same. Yoke 14 is shown in enlarged detail in FIG. 2. Yoke 14 has an arm 18 and an arm 20 which form the bifurcated yoke. The interior surface 22 of the arms is eight-sided with the sides each being equal and the angles being equal, except for the one side between fingers 24 and 26 which is equal in dimension but is open.

Wrench head 28 has first and second wrench bodies 30 and 32. The wrench bodies have exterior surfaces 34 and 36, both of which are an exact slip-fit into the opening in the yoke defined by the interior surface 22. Pivot pin 38 extends through the fingers 24 and 26 of the yoke and through the shank 40 which joins the two bodies 30 and 32 on the wrench head. The pivot pin permits the wrench head to pivot in the yoke. The wrench bodies 30 and 32 respectively have wrenching surfaces 42 and 44 formed therein. In FIG. 2, these wrenching surfaces are in the form of a box end wrench, which usually has a number of projections therein to engage on six-sided or four-sided nuts. While a box end wrenching surface is described, open-ended wrench heads are also useful and will be described below. The two wrenching surfaces 42 and 44 are of different sizes so that either may be swung to the outer or wrenching position, upward as seen in FIG. 2, for applying maximum torque to a nut or a bolt. It should be noted that the inner position, occupied by body 32 in FIG. 2, is useful in those situations where the maximum torque is not required; this utility is in addition to the described use of the inner position for maintaining ready availability of the body in that location for exchange with the body in the outer position by mere rotation.

It is seen that the wrench head can be pivoted in the yoke so that either of the wrenching bodies can be extended outward for use. Structure is provided to retain the wrench head in the selected position with either of the bodies 30 or 32 extended outward. Two structures are provided for retaining the wrench head in the selected position. As seen in FIG. 3, arm 18 has a detent opening 46 therein. Within the detent opening 46 is a detent spring 48 and detent ball 50. The detent ball 50 extends part way out of the detent opening.

The side of the wrench head 28 has a detent ball recess 52 in which the detent ball resiliently engages to hold the wrench head in position. This is a resilient retaining structure.

In addition, the wrench head 28 is held in position by means of a lock pin, as seen in FIG. 4. Lock pin opening 54 is formed in arm 20. Lock pin 56 has a head 58 outside of the opening. A washer on the lock pin, a spring around the lock pin and a spring cap over the opening provide a structure by which the lock pin can be withdrawn by grasping its head. When the lock pin is withdrawn, the wrench head 28 can be rotated into position. When in position, the lock pin is released and extends into the lock pin pocket 60 in the wrench head 28. This positively locks the wrench head in position. The detent system 46–52 pre-positions the wrench head 28 so that the lock pin goes easily into its pocket 60.

A wrench head 28 with wrenching surfaces in the form of box end wrenches is shown in FIGS. 1 and 2. An alternate wrench head 62 is also shown in FIG. 1. The alternate wrench head has the same external configuration so that it accurately and closely fits within the yoke and has the same pivot pin opening so that it can be substituted for the wrench head 28. Its wrenching surfaces 64 and 66 are in the form of an open-end wrench, which may be useful to the workman. The wrenching surfaces 64 and 66 are of different wrench openings.

The mechanic selects the wrench head 28 or wrench head 68 which has the opening suited to his wrenching requirement. He turns the head so that the desired wrenching surface is extended out of the yoke and the lock pin is put in place. Now, he can apply large torque by means of the wrench handle because the wrench head is tightly embraced within the yoke so that a large torque can be transmitted from the handle to the wrench head without damaging the interengaging structure. When no torque is being applied, the wrench head can be rotated to multiply the selection of wrenching openings available at the job site. Four wrenching openings are immediately available, as seen in FIG. 1, by selecting the end of the wrench and the rotational position of each wrench head. In each rotational position, the wrench head is closely embraced on all available sides by the yoke at each end of the wrench. Additional wrench openings can be made available by merely removing pivot pin 38, exchanging wrench heads with different wrench openings, and re-inserting pivot pin 38. For convenience, pivot pin 38 is provided with an Allen head on its outer end and is threaded on its inner end for threaded securement into finger 24, as seen in FIG. 2.

This invention has been described in its presently contemplated best modes and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A wrench comprising:

an elongated handle having first and second ends, said first end being bifurcated to form a yoke having an interior surface, said yoke terminating in first and second spaced fingers;

a wrench head having first and second bodies, said first and second bodies each having an exterior surface, a shank between said bodies, said first and second bodies respectively having first and second wrenching surfaces thereon, said exterior surface of each of said bodies being formed of seven flat surfaces equiangularly arranged with respect to each other, said shank being sized to lie between said fingers and lie in engagement with said fingers said shank having the same width as the length of one of said surfaces on said body;

a pivot pin extending into said fingers and into said shank so that either said first body or said second body can lie within said yoke, said exterior surface of said bodies being of the same configuration and being sized to closely fit against said interior surface of said yoke so that torque applied to said handle is transferred from said handle to said wrench head through contact of one of said wrench bodies against the interior surface of said yoke.

2. The wrench of claim 1 wherein said wrenching surfaces in said first and second bodies on said first wrench head are box wrench surfaces.

3. A wrench comprising:

an elongated handle having first and second ends, said first end being bifurcated to form a yoke having an interior surface, said yoke terminating in first and second spaced fingers;

a wrench head having first and second bodies, said first and second bodies each having an exterior surface, a shank between said bodies, said first and second bodies, respectively having first and second wrenching surfaces thereon, said exterior surface of each of said bodies being formed of seven flat surfaces equiangularly arranged with respect to each other; said shank being sized to lie between said fingers and lie in engagement with said fingers, said shank having the same width as the length of one of said surfaces on said body;

a pivot pin extending into said fingers and into said shank so that either said first body or said second body can lie within said yoke, said exterior surface of said bodies being of the same configuration and being sized to closely fit against said interior surface of said yoke so that torque applied to said handle is transferred from said handle to said wrench head through contact of one of said wrench bodies against the interior surface of said yoke; and said second end of said handle carrying a second yoke and a second wrench head yoke and configured in the same manner as said first wrench head engaging in said first yoke.

4. A wrench comprising:

an elongated wrench handle, said elongated handle being configured for manual engagement, said handle having first and second ends, each of said first and second ends being bifurcated to form first and second arms, said first and second arms terminating in first and second fingers, said arms defining an interior yoke surface;

a wrench head, said wrench head having first and second bodies and a shank interconnecting said bodies, the exterior surface of each of said bodies being configured so as to be a mating surface to said interior surface of said yoke so that said yoke engages all the way around said body up to said fingers around said shank :to form mating surfaces for maximum torque transfer from said handle to said wrench head;

a first set of wrenching surfaces on said first body and said second set of wrenching surfaces on said second body, each of first and second sets of wrenching surfaces being configured to engage upon a structure to be wrenched, said wrenching surfaces on said first body being all on said first body and said wrenching surfaces in said second body being all on said second body;

a pivot pin extending into said fingers and into said shank so that said wrench head can be rotated so that either one of said bodies can be selected to be in mating position within said yoke, each of said first and second bodies having a wrenching surface thereon so that either one of said bodies can extend out of said yoke for use to apply torque to a bolt;

said second end of said handle and said second yoke having a second wrench head pivoted therein, said second wrench head having third and fourth bodies respectively with third and fourth sets of wrenching surfaces thereon, said third and fourth sets of wrenching surfaces all being on said third and fourth bodies respectively, said third and fourth bodies being configured so that either can be in mating surface relationship in said second yoke so that a suitable wrenching surface can be selected.

5. The wrench of claim 4 wherein said first and second yokes have the same shape of interior surface so that said wrench heads are interchangeable between said yokes.

6. The wrench of claim 4 wherein there is interengaging structure between said wrench head and said yoke to releaseably retain one of said bodies within said yoke while the wrenching surface on the other body is used for wrenching purposes.

7. The wrench of claim 6 wherein said interengagement between said yoke and said wrench head is a releasable positively engaging pin to positively retain said first body in said first yoke so that said wrenching surface on said second body can be utilized.

8. The wrench of claim 4 wherein said pivot pin through said fingers and through said shank is removable so that a different wrench head having different wrenching surfaces may be installed in said yoke, said different wrench head also having an exterior configuration providing mating surfaces all the way around the interior of said yoke.

9. A wrench comprising:

an elongated wrench handle, said elongated handle being configured for manual engagement, said handle having first and second ends, each of said first and second ends being bifurcated to form first and second arms, said first and second arms terminating in first and second fingers, said arms defining an interior yoke surface;

a wrench head, said wrench head having first and second bodies and a shank interconnecting said bodies, the exterior surface of each of said bodies being configured so as to be a mating surface to said interior surface of said yoke so that said yoke engages all the way around said body up to said fingers around said shank to form mating surfaces for maximum torque transfer from said handle to said wrench head, said mating surface between said wrench body and said interior yoke surface being a plurality of flat surfaces equiangularly arranged with respect to each other;

a pivot pin extending into said fingers and into said shank so that said.wrench head can be rotated so that either one of said bodies can be selected to be in mating position within said yoke, said pivot pin through said fingers and through said shank being removable so that a different wrench head having different wrenching surfaces may be installed in said yoke, said different wrench head also having an exterior configuration providing mating surfaces all the way around the interior of said yoke, each of said first and second bodies having a wrenching surface thereon so that either one of said bodies can extend out of said yoke for use to apply torque to a bolt;

said second end of said handle and said second yoke having a second wrench head pivoted therein, said second wrench head having third and fourth bodies respectively with third and fourth wrenching surfaces thereon, said third and fourth bodies being configured so that either can be in mating surface relationship in said second yoke so that a suitable wrenching surface can be selected.

10. A wrench comprising:

an elongated wrench handle, said elongated handle being configured for manual engagement, said handle having first and second ends, each of said first and second ends being bifurcated to form first and second arms, said first and second arms terminating in first and second fingers, said arms defining an interior yoke surface;

a wrench head, said wrench head having first and second bodies and a shank interconnecting said bodies, the exterior surface of each of said bodies being configured so as to be a mating surface to said interior surface of said yoke so that said yoke engages all the way around said body up to said fingers around said shank to form mating surfaces for maximum torque transfer from said handle to said wrench head, said mating surface between said wrench body and said interior yoke surface being a plurality of flat surfaces equiangularly arranged with respect to each other;

a pivot pin extending into said fingers and into said shank so that said wrench head can be rotated so that either one of said bodies can be selected to be in mating position within said yoke, each of said first and second bodies having a wrenching surface thereon so that either one of said bodies can extend out of said yoke for use to apply torque to a bolt;

said second end of said handle and said second yoke having a second wrench head pivoted therein, said second wrench head having third and fourth bodies respectively with third and fourth wrenching surfaces thereon, said third and fourth bodies being configured so that either can be in mating surface relationship in said second yoke so that a suitable wrenching surface can be selected.

* * * * *